US006854594B2

(12) United States Patent
Vasudeva et al.

(10) Patent No.: US 6,854,594 B2
(45) Date of Patent: Feb. 15, 2005

(54) PRODUCT HOLDER WITH POINT-OF-SALE SECURITY

(75) Inventors: Kailash C. Vasudeva, Waterloo (CA); Scott W. Allan, Kitchener (CA); Satnam Singh, Waterloo (CA)

(73) Assignee: Maxtech Manufacturing Inc., Waterloo (CA)

( * ) Notice: Subject to any disclaimer, the term of this patent is extended or adjusted under 35 U.S.C. 154(b) by 110 days.

(21) Appl. No.: 10/214,589

(22) Filed: Aug. 9, 2002

(65) Prior Publication Data

US 2003/0029756 A1 Feb. 13, 2003

Related U.S. Application Data

(60) Provisional application No. 60/311,084, filed on Aug. 10, 2001.

(51) Int. Cl.[7] ..... B65D 45/00
(52) U.S. Cl. ..... 206/1.5; 215/216; 215/273
(58) Field of Search ..... 215/201, 216, 215/273, 277, 280; 206/806, 807, 1.5

(56) References Cited

U.S. PATENT DOCUMENTS 3,023,925 A * 3/1962 Sher ..... 220/786
4,378,068 A * 3/1983 Bell ..... 206/461
4,445,622 A * 5/1984 Sideri ..... 220/3.6
4,480,762 A 11/1984 Thomas
4,712,671 A * 12/1987 Salacuse ..... 206/736
5,373,953 A * 12/1994 Fenton et al. ..... 215/228
5,740,911 A * 4/1998 Chou ..... 206/378
5,918,752 A * 7/1999 Meyer ..... 215/204
5,979,649 A 11/1999 Rosler
5,988,413 A * 11/1999 Nagel ..... 215/216
6,662,948 B1 * 12/2003 Velliquette ..... 206/488

* cited by examiner

*Primary Examiner*—Jacob K. Ackun, Jr.
(74) *Attorney, Agent, or Firm*—R. Craig Armstrong; Borden Ladner Gervais LLP

(57) ABSTRACT

A point-of-sale security system is provided herein. The security system includes a container for containing the product and a holder assembly, the holder assembly including a closure device for closing the container. The holder assembly and the container are operatively coupled together by means of cooperative members. The cooperative members being configured in a special way, i.e., when an associated stop member is enabled, the cooperative members prevent decoupling of the holder assembly from the container, and when the stop member is disabled, the cooperative members enable decoupling of the holder assembly from the container.

19 Claims, 12 Drawing Sheets

PRODUCT HOLDER WITH POINT-OF-SALE SECURITY

REFERENCE TO RELATED APPLICATION

This is a formal application based on and claiming the benefit of U.S. provisional patent application No. 60/311,084, filed Aug. 10, 2001.

BACKGROUND OF THE INVENTION

1. Field of the Invention

This invention relates to a product container having point-of-sale security inherent therein. After purchase, the point-of-sale security feature is disabled, and the product container may be used by the consumer to store the article or articles which are sold in the product container.

2. Description of the Prior Art

There are many patents directed to providing articles in a container which is sold to consumers. One such patent is U.S. Pat. No. 6,321,944 issued Nov. 27, 2001 to E. M. Centrangolo.

There are also many patents directed to providing evidence that the contents of a container have been tampered with. Among such patents are the following:

U.S. Pat. No. 6,191,898 issued Sep. 19, 2000 to R. C. G. Dark;

U.S. Pat. No. 5,875,902 issued Mar. 2, 1999 to Dieter F. Lay;

U.S. Pat. No. 5,799,840 issued Sep. 1, 1998 to Jens Mogard;

U.S. Pat. No. 5,386,918 issued Feb. 7, 1995 to George J. Neveras et al; and

U.S. Pat. No. 5,356,044 issued Oct. 18, 1994 to Donald La Vange.

However, none of these patents provide a point-of-sale security feature.

SUMMARY OF THE INVENTION

Aims of the Invention

Accordingly it is a first object of the present invention to provide a point-of-sale security feature to a container having an article therein.

A second object of the invention is to provide an attachment for such container having an article therein, so that such point-of-sale security may be provided.

A third object of the present invention is to provide such an attachment which cannot readily be bypassed or disabled, thereby voiding such point-of-sale security.

STATEMENT OF INVENTION

The present invention provides a point-of-sale security system for a product. The point-of-sale security system includes a container for containing the product, and a holder assembly, the holder assembly including a closure device for the container. The closure device and the container are provided with cooperative members which are operatively associated with the container and with the closure device. The cooperative members are configured such that, when enabled by a stop member, the container is prevented from being decoupled from the device and when the stop member is disabled, the container can be decoupled from the holder device. The stop member is configured to be selectively prevented from enabling the decoupling of the container and the device.

OTHER FEATURES OF THE INVENTION

In a first preferred feature of this invention, the closure device is a cap for the container, the cap being integral with, and projecting outwardly from, the holder assembly, e.g., the hang tag.

In a first subsidiary feature of this first preferred feature of this invention, the cap includes a pair of flexibly-movable parts, the holder assembly, e.g., the hang tag, is integrally associated with the stop member, and the holder member, e.g., the hang tag is configured to be severed, along with its stop member, from the cap and to be discarded. This disables the stop member and enables the cap to be decoupled from the container.

In a second subsidiary feature of this first preferred feature of this invention, the cap includes a pair of slits to enable flexing of the two associated flexibly-movable parts of the cap. When the two associated, flexibly-movable parts of the cap are urged towards one another, the cap can be decoupled from the container.

In an auxiliary feature of this second subsidiary feature of this first preferred feature of this invention, the cap is provided with at least two external locking ramped projections and the container is provided with a like number of cooperating locking apertures. These ramped projections and apertures enable the cap and the container to be selectively coupled and decoupled.

In a fourth subsidiary feature of this first preferred feature of this invention, the stop member is an integral tongue projecting from the holder assembly, e.g., the hang tag, and that tongue is slidably disposed within a longitudinal slot between two opposed integral internally-oriented projections within the interior of the cap.

In a fifth subsidiary feature of this first preferred feature of this invention, the cap comprises two flexibly-movable parts which are held in united orientation by a pair of integrally-molded straps, so that these integrally-molded straps comprise the stop member. When the straps are severed, the parts of the cap may be urged towards one another, so that the cap can be decoupled from the container.

In an auxiliary feature of this fifth subsidiary feature of this first preferred feature of this invention, the cap is provided with at least two external locking ramped projections and the container is provided with a like number of cooperating locking apertures. These ramped projections and apertures enable the cap and the container to be selectively coupled and decoupled.

In a sixth subsidiary feature of the first preferred feature of this invention, the flexibly-movable parts of the cap are held together, and the cap is simultaneously secured to the container, by means of a pin passing through cooperating aligned apertures in the cap and the container, the pin being secured in the aperture. When the pin is structurally-altered to enable its removal from the apertures, the two parts of the cap may be urged towards one another, so that the cap can be decoupled from the container.

In a first auxiliary feature of this sixth subsidiary feature of the first preferred feature of this invention, the two flexibly-movable parts of the cap are also held together by severable, integrally-molded straps.

In a second auxiliary feature of this sixth subsidiary feature of the first preferred feature of this invention, the cap is provided with at least two external locking ramped projections, and the container is provided with a like number of cooperating locking apertures. These ramped projections and apertures enable the cap and the container to be selectively coupled and decoupled.

In a seventh subsidiary feature of this first preferred embodiment of this invention, the cap is secured to the holder assembly, e.g., the hang tag, by mushroom pins and cooperating apertures operatively associated with the holder member, e.g., the hang tag and the cap. When the mushroom pins are structurally-altered to enable removal from the apertures, the two parts of the cap can be urged towards one another, so that the cap can be decoupled from the container.

In a first auxiliary feature of this seventh subsidiary feature of this first preferred embodiment of this invention, the cap is provided with at least two external locking ramped projections and the container is provided with a like number of cooperating locking apertures. These ramped projections and apertures enable the cap and the container to be selectively coupled and decoupled.

In a second auxiliary feature of this seventh subsidiary feature of this first preferred embodiment of this invention, the stop member is an integral tongue projecting from the holder assembly, e.g., the hang tag, and that tongue is slidably disposed within a longitudinal slot between two opposed integral internally-oriented projections within the interior of the cap.

In a second preferred feature of this invention, the holder assembly is preferably a hang tag, and the holder assembly, e.g., the hang tag, is provided with an integral cap which is inset within the lower edge of the holder assembly, e.g, the hang tag.

In a first auxiliary feature of this second preferred feature of this invention, the stop member is an integral tongue depending from the holder assembly, e.g., the hang tag, and is situated within the integral cap. Severing of the holder assembly, e.g., the hang tag and tongue enables separation of the holder assembly, e.g., the hang tag, from the container. Manual removal of the severed tongue enables access to the contents of the container.

Yet another feature is the cap portion having tabs extending axially therefrom, which engage in corresponding slots in the end of the tube, to act as a further obstacle to prevent twisting of the tube in an attempt to separate it from the hang tag.

Further features will be described or will become apparent in the course of the following detailed description.

GENERALIZED DESCRIPTION OF THE INVENTION

The present invention provides a combination of a container and a holder assembly, e.g., a hang tag. In one embodiment, the container can only be separated from the holder, e.g., the hang tag by cutting at cut points. This is something which the purchaser can do easily at home, but not so easily in a retail (store) environment. Once the holder, e.g., hang tag, is separated from the container, a part of the holder, e.g., hang tag, can be used as a cap for the container.

In other embodiments, destructible straps, or destructible pins, when cut or structurally-altered, enable the container to be decoupled from the holder assembly, e.g., the hang tag.

The container can be used to hold a variety of single or multiple articles. Among the articles which can be so held are small hardware items, e.g., drill bits, toiletry articles, OTC medications, shampoos, toothpaste, etc. The container preferably is cylindrical.

BRIEF DESCRIPTION OF THE DRAWINGS

In the accompanying drawings,

FIGS. 9 to 11 are views of an embodiment in which the cap has a through hole for hanging the container and cap once they have been separated as a unit from the security element and holder assembly, e.g., hang tag, in which FIG. 9 is a plan view thereof, FIG. 10 is a side view thereof, and FIG. 11 is a plan view in partial section;

FIGS. 12, 13 and 14 are views of an overall assembly including an example of a drill bit within the container, as shown in FIG. 1, in which FIG. 12 is a decoupled front view, FIG. 13 is a coupled front view, and FIG. 14 is a coupled side view;

FIGS. 15 to 17 are views of another embodiment of the invention in which the security element includes an integrally-molded strap between opposed sides of the cap, in which FIG. 15 is a side view thereof in its coupled orientation, FIG. 16 is a side view thereof after the strap has been cut to enable decoupling, and FIG. 17 is an enlarged close-up of the view of FIG. 16;

FIGS. 18 to 20 are views of yet another embodiment of this invention in which the security element includes a pin securing the container to the cap which is integral with the holder assembly, e.g., hang tag, in which FIG. 18 is a decoupled front view thereof, FIG. 19 is a coupled front view thereof, and FIG. 20 is a coupled side view thereof also showing insertion of a pin;

FIGS. 21 to 27 are views of still another embodiment of this invention in which one portion of the security element includes protruding mushroom pins to engage the cap, and a stop member which is integral with another portion of the holder member assembly, e.g., hang tag, of the security element, in which FIG. 21 is a front view of the coupled holder assembly, e.g., hang tag and cap, FIG. 22 is a side view of the view shown in FIG. 21, FIG. 23 is a front view of the holder assembly, e.g., hang tag, including the security element, FIG. 24 is a side view of the view shown in FIG. 23, FIG. 25 is a front view of the cap element, FIG. 26 is a side view of the cap element, and FIG. 27 is a bottom view of the cap element; and FIG. 28 and FIG. 29 are views of yet a further embodiment of the invention in which the cap is inset rather than projecting from the lower edge of the holder assembly, e.g., hang tag, in which FIG. 28 is a front view thereof;

FIG. 29 is a side view thereof; and

DESCRIPTION OF THE PREFERRED EMBODIMENT

Description of FIGS. 1 to 4

Figure 1:
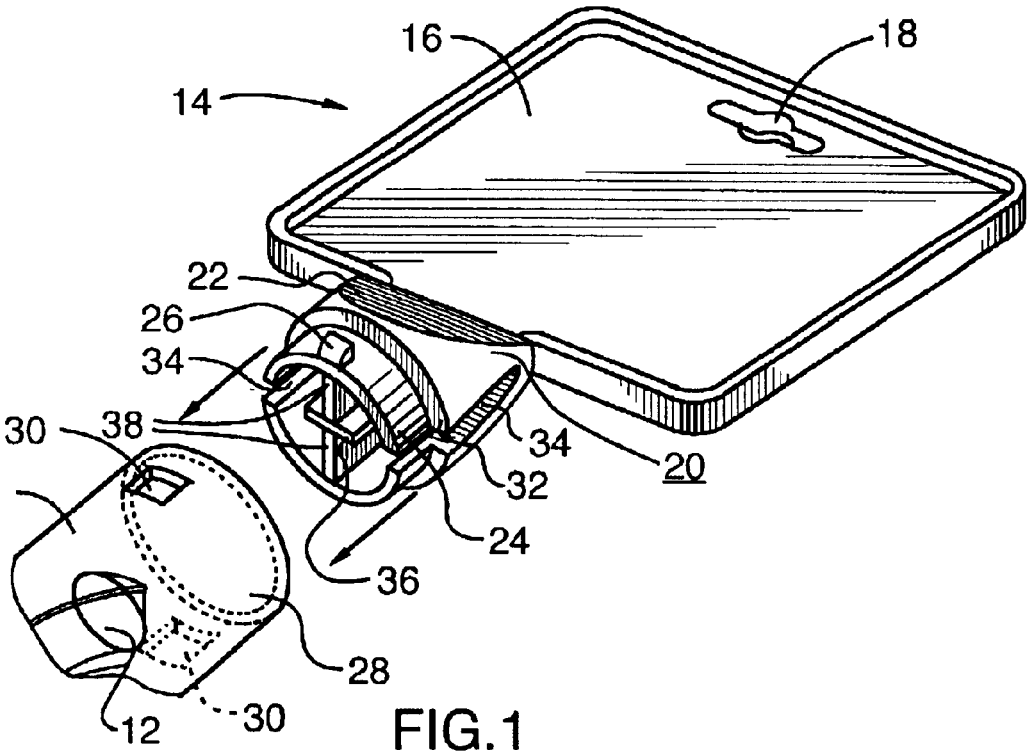
FIG. 1 is an exploded perspective view showing a product-containing tube and a cap including a point-of-sale security element associated with an integral holder assembly, e.g., hang tag.

FIG. 1 shows one embodiment of the present invention in the form of a container 10 which is constituted by the form of a cylindrical tube containing a product 12, e.g., a drill bit, and a holder assembly 14. The holder assembly 14 preferably is a hang tag portion 16 which preferably has a hole 18 for hanging the product 12 at the point-of-sale. The holder assembly 14 also initially includes an integral projecting cap portion 20 which may be separated from the holder assembly 14 (hang tag 16) by cutting at two cut points, to be described hereinafter.

The cap portion 20 includes a primary portion 22 which is integral with the holder assembly 14 (hang tag 16), and a reduced diameter portion 24. Reduced diameter portion 24 is provided with two, diametrically-opposed integral locking ramped projections 26 (only one of which can be seen) along its outer circumference.

The end 28 of the tube 10 is provided with two diametrically-opposed locking openings 30. The locking ramped projections 26 are configured to engage with the locking openings 30 to lock the tube 10 in place against a face 32 of the larger-diameter primary portion 22 of the cap 20.

The cap 20 has two diametrically-opposed, longitudinally-extending slots 34, which can be urged to closer proximity at their open ends to permit the locking ramped projections 26 to mate with the locking openings 30 in order to couple the tube 10 with the cap 20. These slots 34 also permit the cap 20 to be manually squeezed so that the locking ramped projections 26 can be disengaged from the locking openings 30, to decouple the cap 20 from the tube 20.

Such removal of the cap 20 from the tube 10 is prevented by a security element provided by various embodiments of this invention. One embodiment of such security element, as shown in FIGS. 1 to 4, comprises a tongue 36 which projects into the interior of the cap 20 and which is integral with the holder assembly 14 (hang tag 16). The tongue 36 is slidably disposed between two integral, inwardly-oriented projections 38 within the interior of the cap 20. It is noted that the tongue 36 and the two internal inwardly-oriented projections 38 have a cruciform shape.

Figure 2:
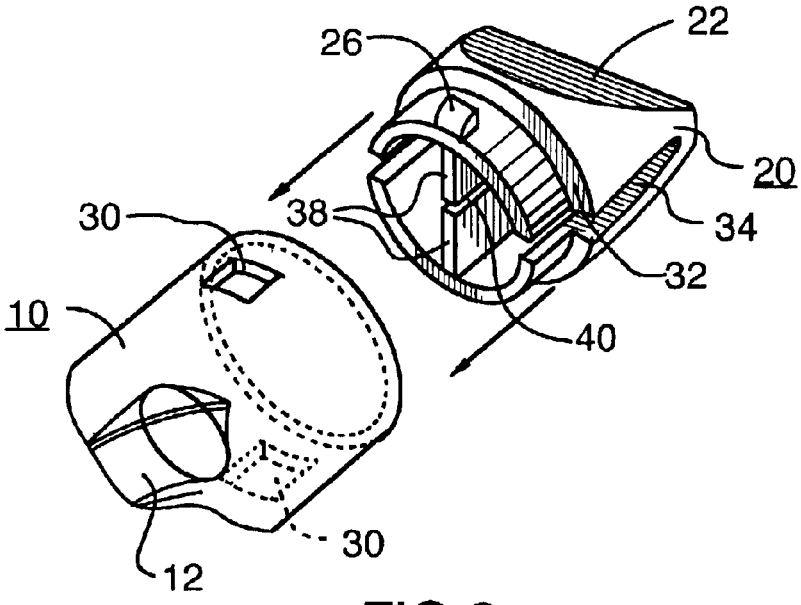
FIG. 2 is an exploded perspective view similar to that in FIG. 1, showing the tube, and the cap which are no longer integrally associated with the security element and holder assembly, e.g., hang tag.

Once the holder assembly 14 (hang tag 16) is cut away from the cap 20 and is discarded, as shown in FIG. 2, the tongue 36 no longer is seen. In its place, is a longitudinally-extending slot 40 between the two internal inwardly-oriented projections 38.

In the absence of the tongue 36, the cap 20 may be manually-squeezed to urge the slots 34 closer together at their open ends to decouple the cap 20 from the tube 10.

Figure 3:
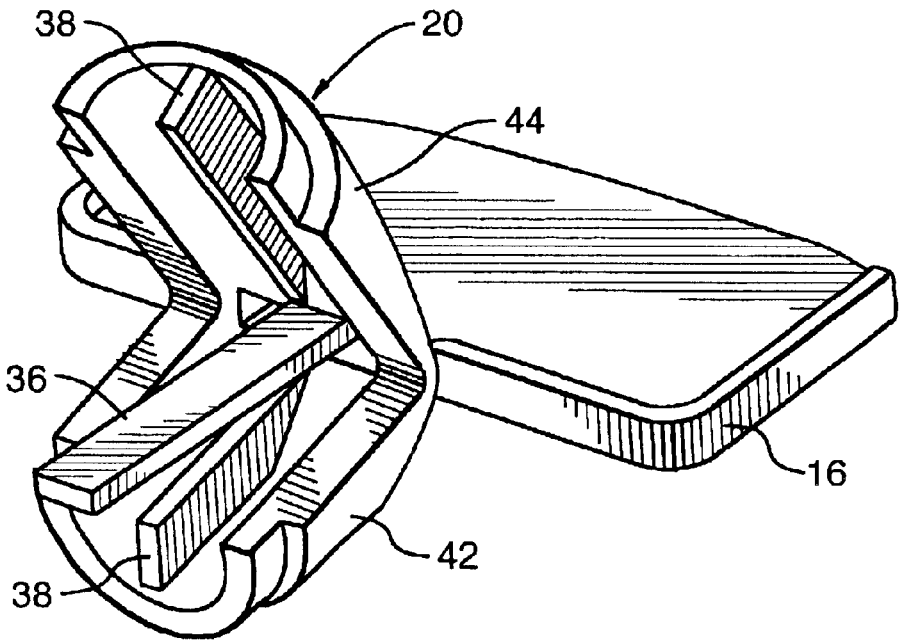
FIG. 3 is a perspective view of an integrally-molded cap and security element and integral holder assembly, e.g., hang tag in its "as-molded" orientation.

FIG. 3 shows the cap 20 holder assembly 14 (hang tag 16) in its "as molded" orientation. It will be noted that the cap 20, as molded is formed of two open jaw parts 42, 44. The inwardly-oriented projections 38 are also seen, as is the tongue 36 which is integral with the holder assembly 16 (hang tag 16).

Figure 4:
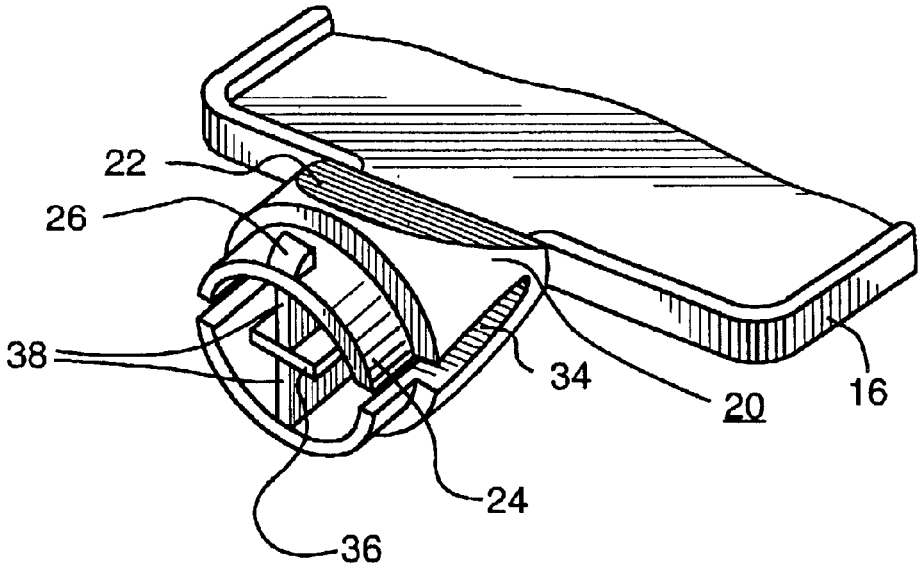
FIG. 4 is a perspective view similar to the view in FIG. 3, but where the cap is in its orientation which is configured to receive the container, as shown in FIG. 1.

FIG. 4 is an enlarged view of FIG. 1 showing the cap 20 and the holder assembly 14 (hang tag 16) in its orientation ready to be received in the tube 10.

Figure 5:
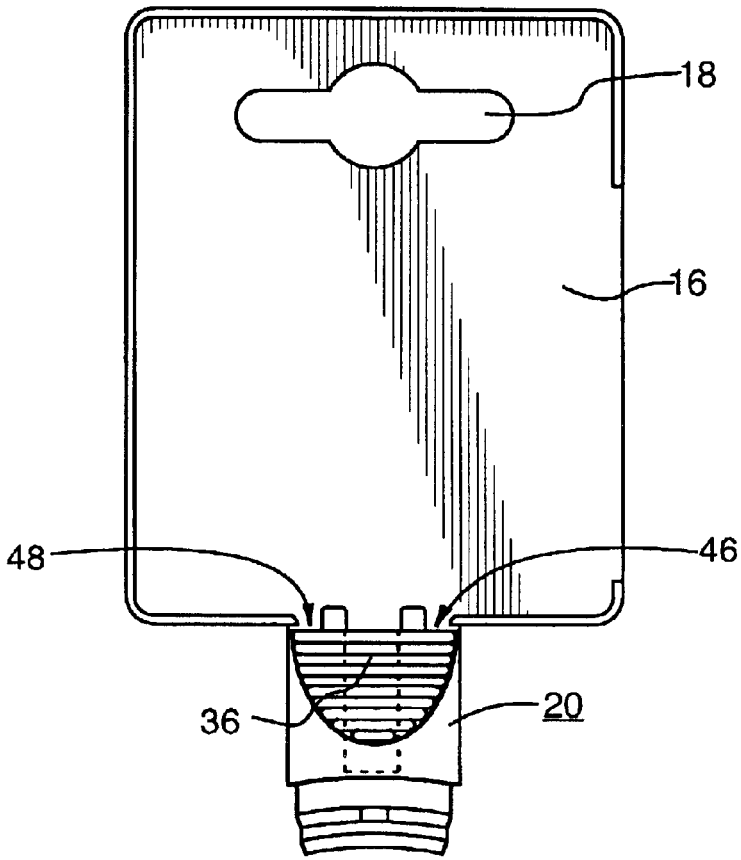
FIG. 5 is a plan view showing cut points to separate the cap from the security element and holder assembly, e.g., hang tag.
Figure 6:
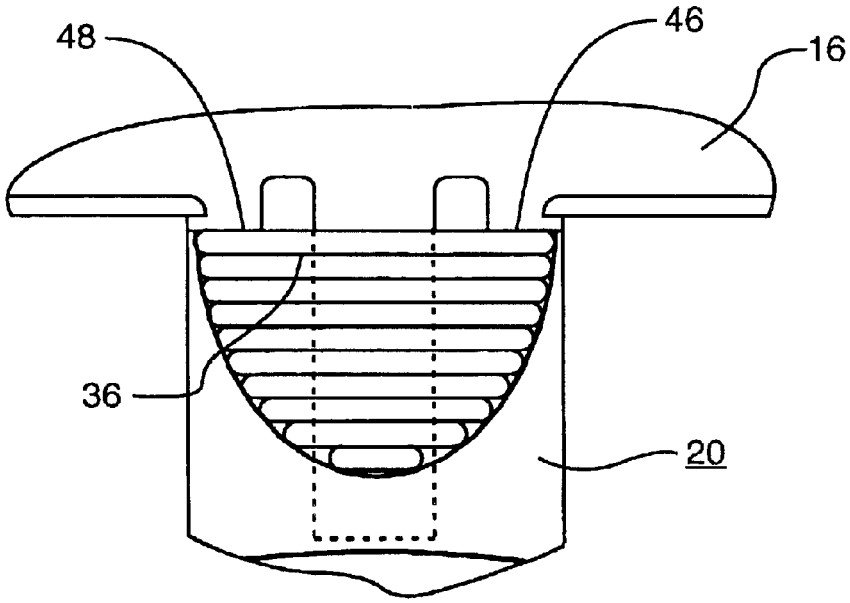
FIG. 6 is an expanded view of the cut point area shown in FIG. 5.

Description of FIGS. 5 and 6

FIGS. 5 and 6 show the cut points to separate the holder assembly 14 (hang tag 16) from the cap 20. In this embodiment, the tongue 36 is integrally molded with the holder assembly 14 (hang tag 16) and is shown projecting downwardly into the cap 20. Cutting the hang tag portion at the two spaced-apart locations 46, 48, allows the holder assembly 14 (hang tag 16) and tongue 36 to be removed as a unit from the cap 20. The cap 20 is still attached to the tube 10. However, as explained hereinabove, the cap 20 may now easily be decoupled from the tube 10 by squeezing the cap 20.

Figure 7:
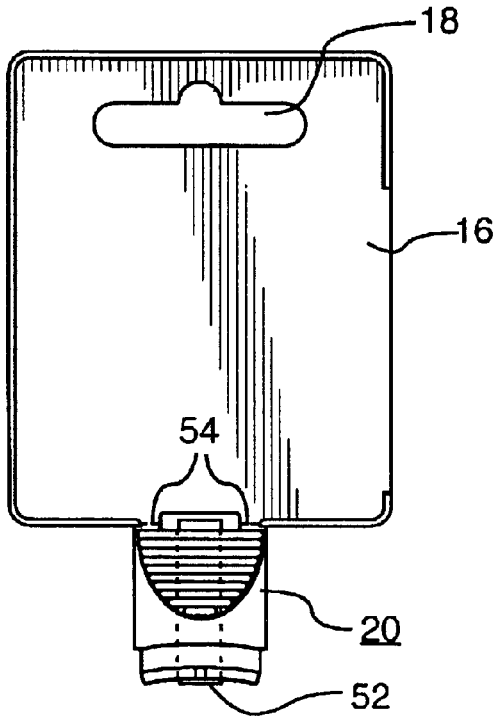
FIG. 7 is a plan view showing an embodiment of the invention in which the security element is inserted between the inward projections within the cap before the cap is attached to the container.
Figure 8:
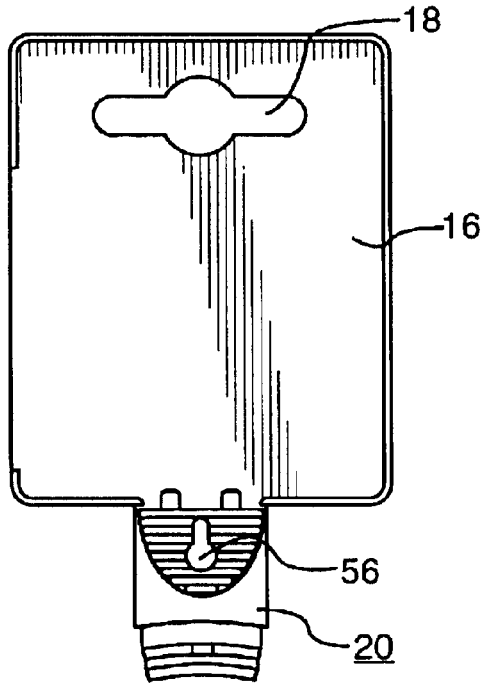
FIG. 8 is a plan view showing an alternative embodiment in which the cap has a "teardrop" hole for hanging the container and cap once they have been separated as an integral unit from the security element and holder assembly, e.g., hang tag.
Figure 11:
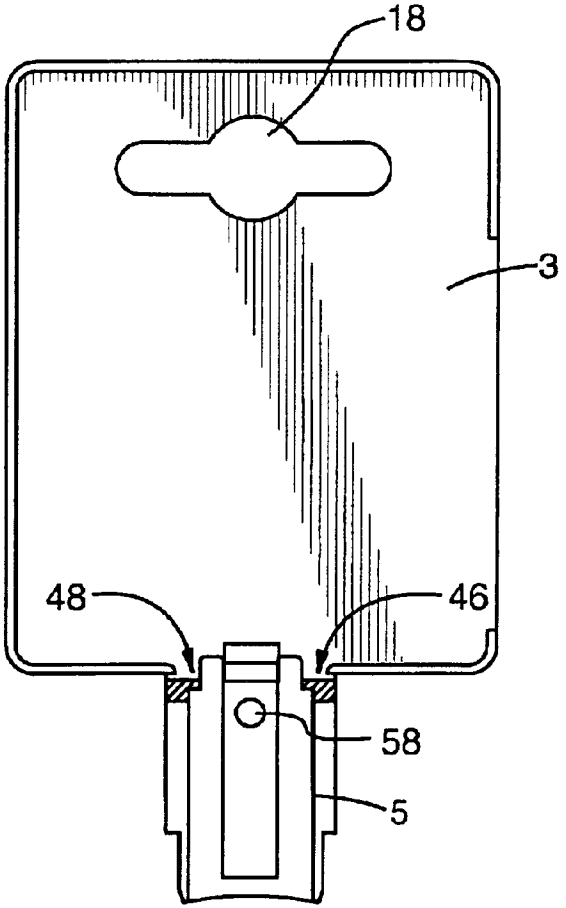
Figure 10:
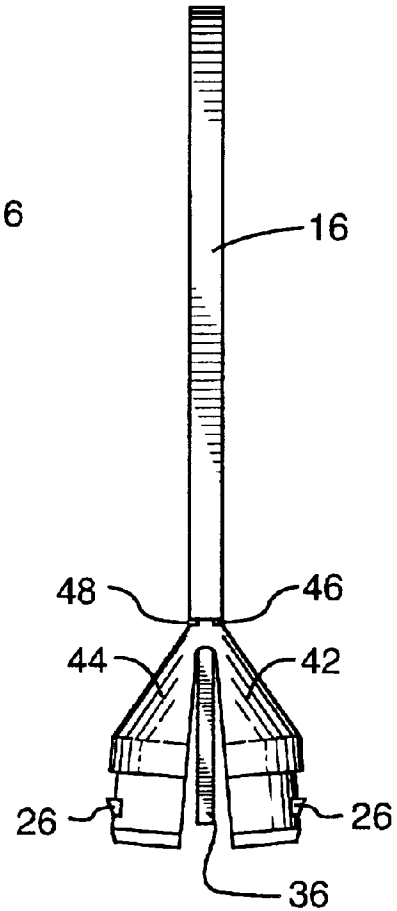
Figure 9:
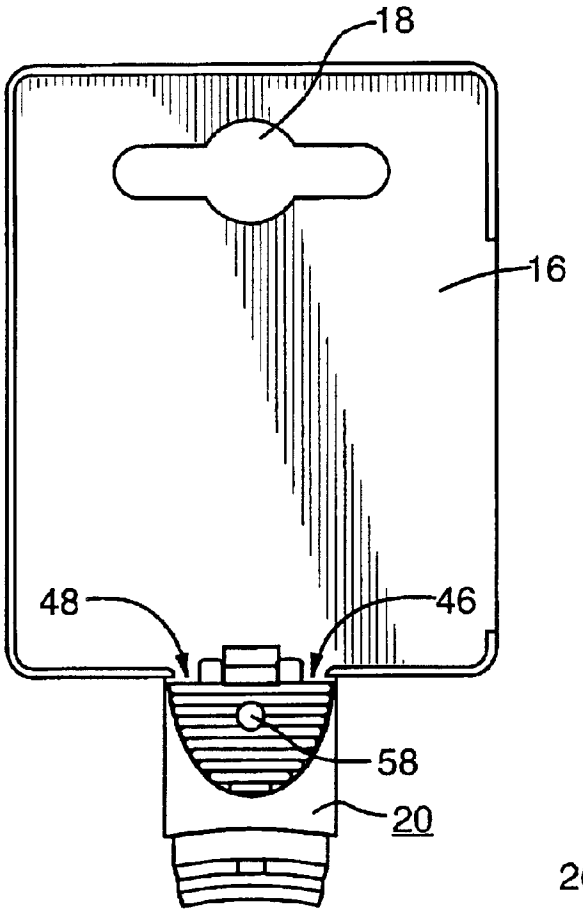

Description of FIG. 7

FIG. 7 shows a second embodiment of the security element combination of this invention. In this embodiment the tongue 52 is a separate piece, which is manually-inserted into the slot 40 between the two inwardly-oriented projections 38 (See FIG. 2) before the cap 20 is attached to the tube 10. In order to decouple the cap 20 from the tube 10, the holder assembly 14 (hang tag 16) can be bent at bend lines 54, and the tongue 52 can then be removed by pliers. The cap 20 can then be squeezed and decoupled from the tube 10 as previously described. The holder assembly 14 (hang tag 16) can be retained or fully separated from the cap 20 and discarded.

Description of FIGS. 8 to 11

FIGS. 8 to 11 show one manner in which the cap 20/tube 10 may be hung up after it is decoupled from the holder assembly 14 (hang tag 16) by the consumer. This manner is by way of either a tear-drop hole 56 (see FIG. 8) or a simple aperture 58 (See FIGS. 8 and 11).

Figure 14:
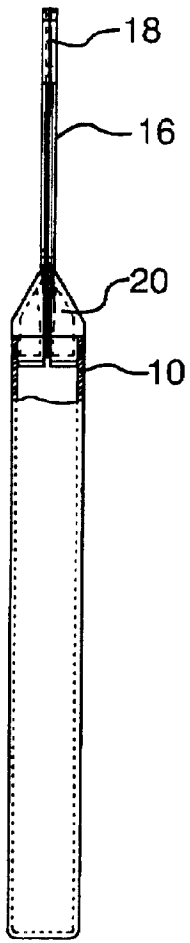
Figure 13:
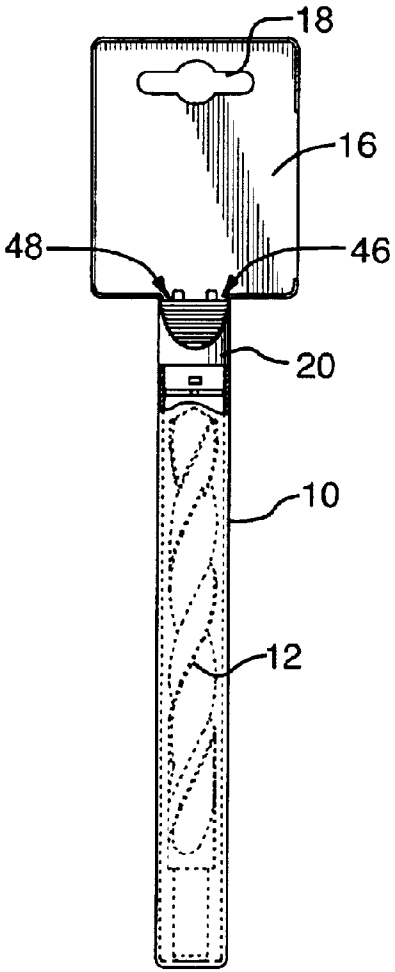
Figure 12:
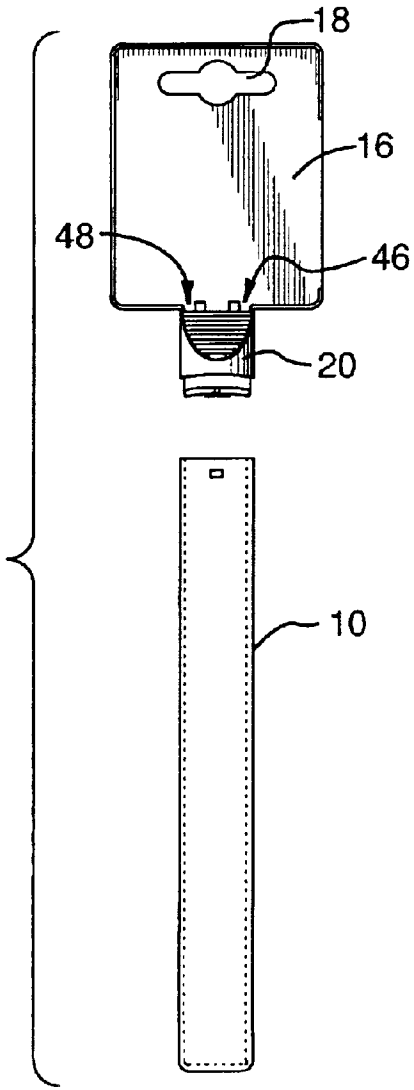

Description of FIGS. 12 to 14

FIGS. 12 to 14 show views of an overall assembly of the holder assembly 14 (hang tag 16), the cap 20 and the tube 10 which includes, for example, a drill bit 12 as the article.

Figure 15:
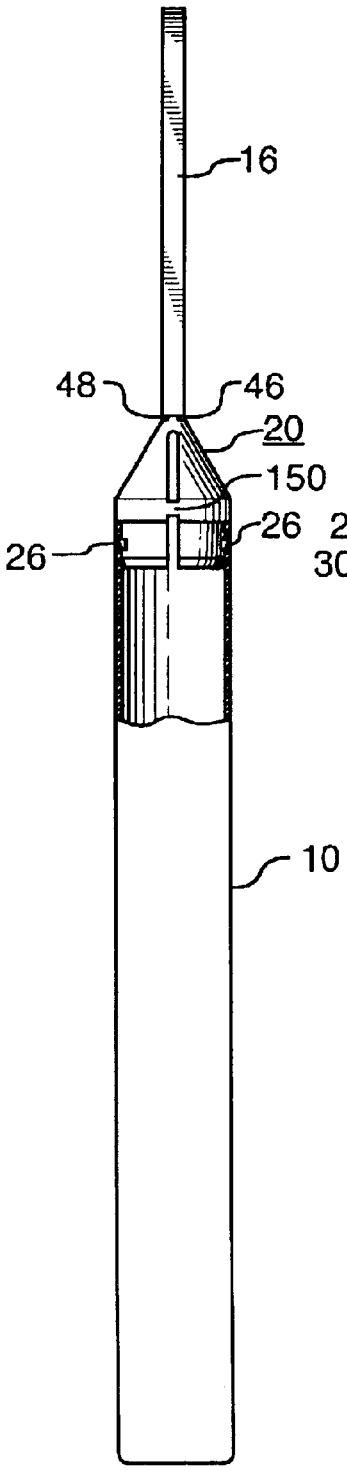
Figure 16:
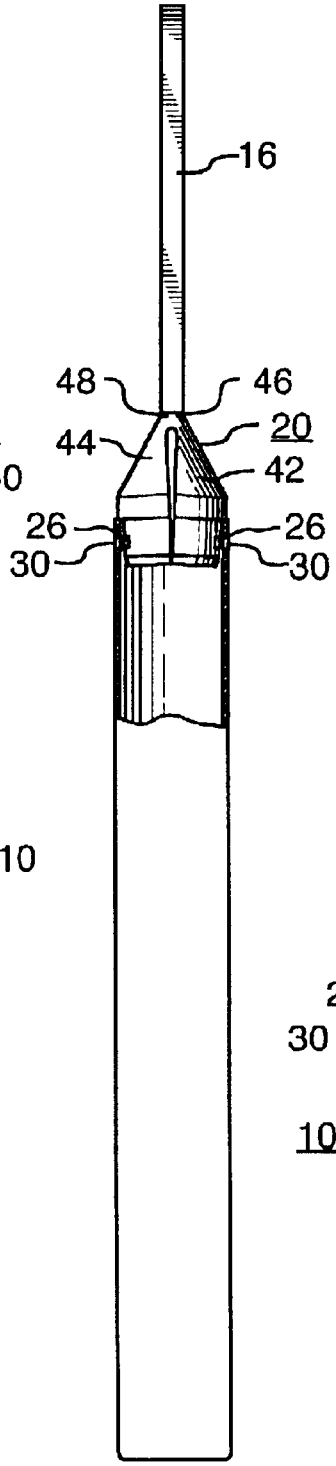
Figure 17:
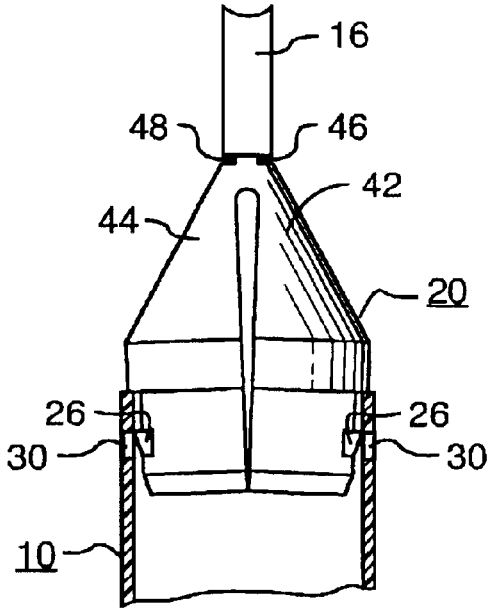

Description of FIGS. 15 to 17

FIGS. 15 to 17 show another embodiment of a security element according to this invention. In this embodiment of the invention, the two parts 42, 44 constituting the cap 20 are secured together, with the cap 20 being integrally attached to the tube 10, by means of an integrally-molded strap 150, (See FIG. 15).

After sale, when the strap 150 is cut by the consumer (See FIGS. 16 and 17) the two parts 42, 44 constituting the cap 20 can flex to enable manually squeezing together thereof.

This permits the locking ramped projections 26 to be removed from the locking apertures 30, and thereby permit the cap 20 to be decoupled from the tube 10.

Figure 20:
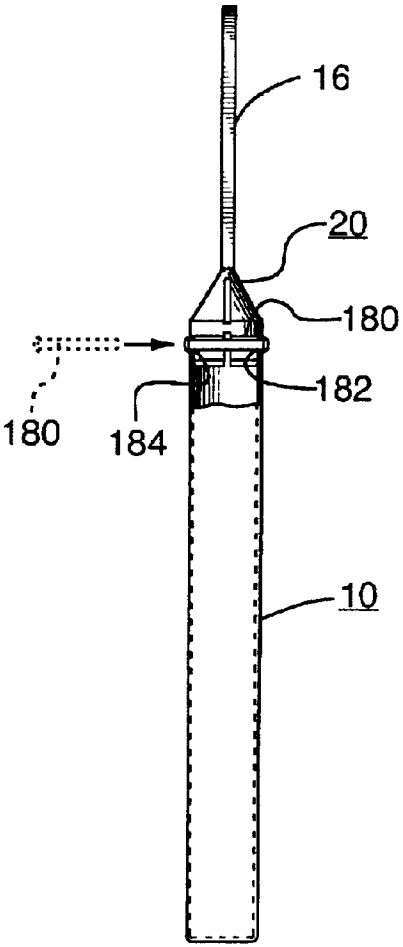
Figure 19:
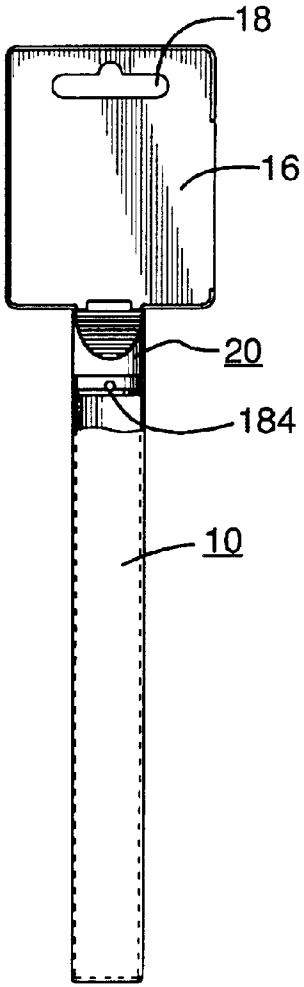
Figure 18:
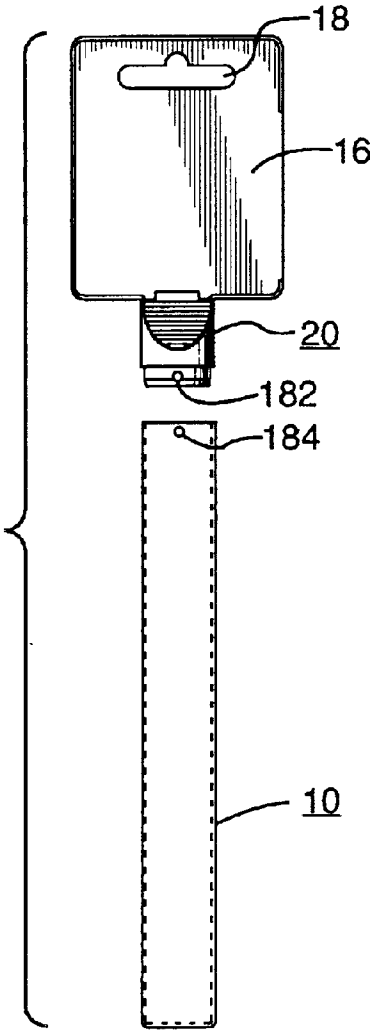
Figure 21:
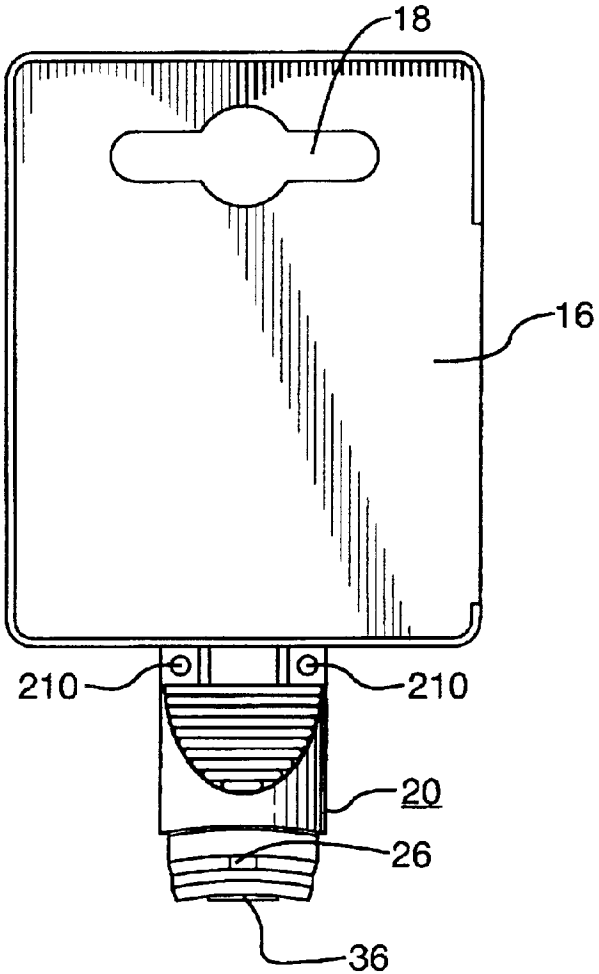
Figure 22:
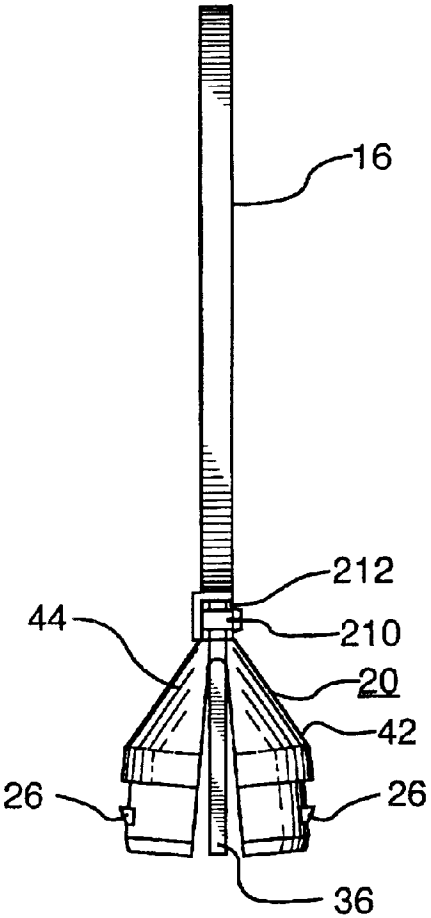
Figure 23:
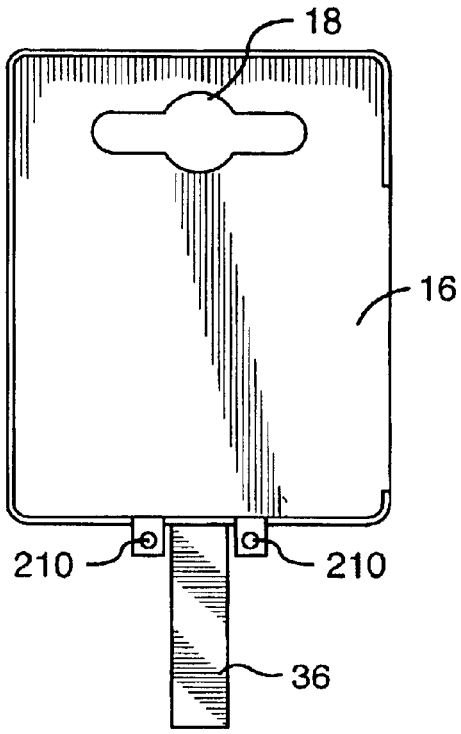
Figure 24:
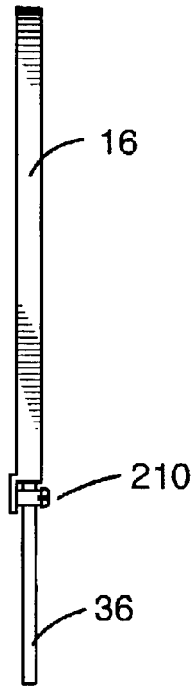
Figure 27:
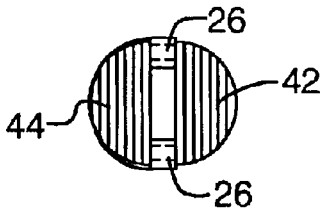
Figure 25:
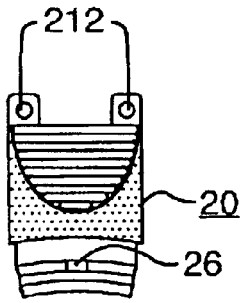
Figure 26:
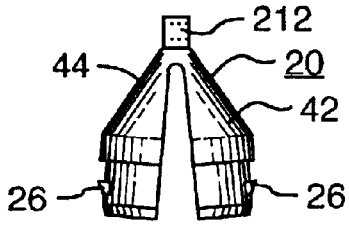

Description of FIGS. 18 to 20

FIGS. 18 to 20 show still another embodiment of a security element according to this invention. In this embodiment of the invention, the tube 10 is secured to the cap 20 by a pin 180 passing through cooperating holes 182 in cap 20 and 184 in tube 10. The pin 180 can be heat-staked after insertion, or flattened on both ends, to make removal at the retail site difficult. However, the flattened ends can be severed, i.e., the pin can be structurally-altered, to enable removal of the pin 180. Once the pin 180 is removed, the cap 20 and tube 10 can be decoupled.

This embodiment also shows the strap 150 (described in FIGS. 15 to 18). However, such strap is not essential for operation of this embodiment of the invention.

Description of FIGS. 21 to 27

FIGS. 21 to 27 show yet still another embodiment of a security element according to this invention. In this embodiment, the cap 20 is secured to the holder assembly 14 (hang tag 16) by means of mushroom pins 210 operatively inserted into associated holes 212. The pins 210 may be provided either on the holder assembly 14 (hang tag 16) or in the cap 20 with the holes 212 respectively in the cap 20 or in the holder assembly 14 (hang tag 16). As shown herein, however, the pins 210 are on the holder assembly 14 (hang tag 16), and the holes 212 are in the cap 20.

In use, the cap 20 is placed onto the tube 10, and the tongue 30 is inserted into the slot 40 in the cap 20 between the two integral inwardly-oriented projections 38. When the holder assembly 14 (hang tag 16) is fully seated, the pins 210 on one component are pressed through the holes 212 in the other component to complete the assembly. The mushroom head prevents removal of the pins 210 from the holes 212. This must be done by special cutters either at the point-of-sale or later by the consumer. However, once the mushroom heads are severed, the pins 210 may be removed from the holes 212, and the cap 20 can be decoupled from the tube 10.

Figure 28:
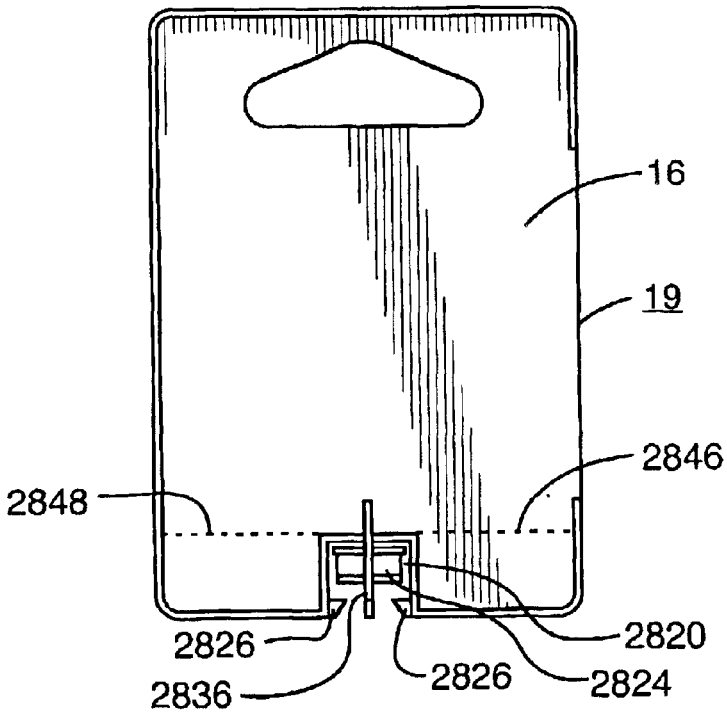
Figure 29:
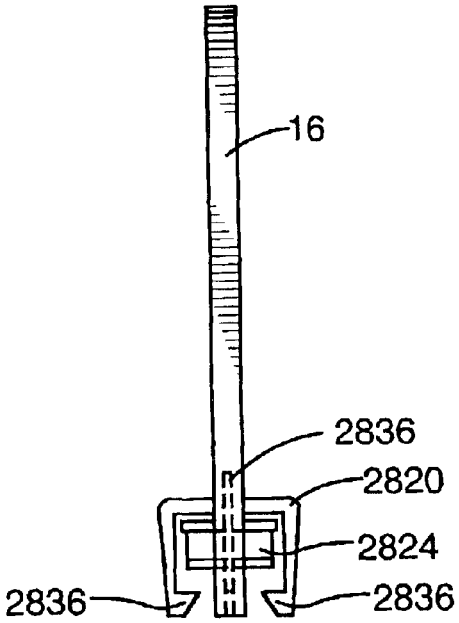

Description of FIGS. 28 and 29

FIGS. 28 and 29 show a still further embodiment of the security element of the present invention. The holder assembly 14 (hang tag 16) is provided with a U-shaped cap 2820 which is inset from the lower edge thereof. The cap 2820 includes a closure element 2824. The lower ends of the U-shaped cap 2820 are provided with inwardly-facing, ramped projections 2826. A stop tongue 2836 is integral with the holder assembly 14 (hang tag 16) and extends through the closure element 2824.

Assembly of the holder assembly 14 (hang tag 16) is the same as the assembly of the cap 20 and tube 10 of FIGS. 1 to 4.

Decoupling is effected by cutting at cut lines 2846, 2848, and removal of the holder assembly 14 (hang tag 16) from the tube. The separated portion of the holder assembly 14 (hang tag 16) constituting the cap 2820 may be used as a cap for the tube 10 as described with respect to FIGS. 1 to 4.

Figure 30:
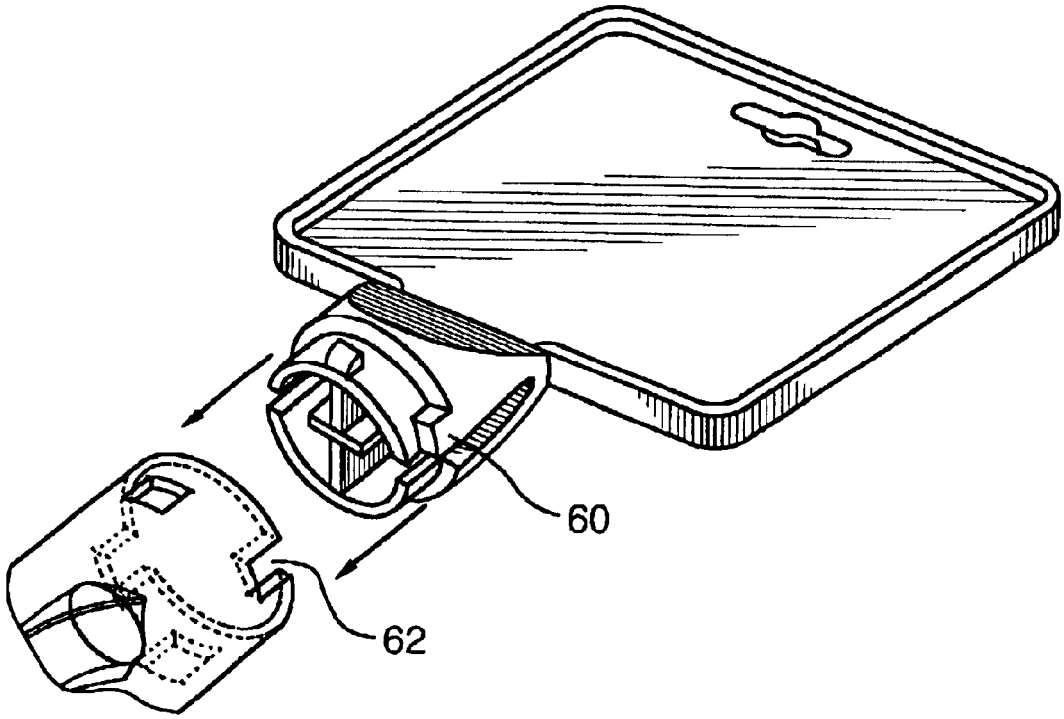
FIG. 30 is a perspective view showing an additional rib or tab aimed at preventing rotation of the tube.

Description of FIG. 30

FIG. 30 shows a still further embodiment of the security element of the present invention. In this embodiment, the cap portion 20 has tabs 60 extending axially therefrom, which engage in corresponding slots 62 in the end of the tube (one on each side of the tube, for example). This acts as a further obstacle to prevent twisting of the tube in an attempt to separate it from the hang tag.

CONCLUSION

The main advantages of embodiments of this invention is the point-of-sale security which is provided, and the potential for the consumer subsequently to reuse the container with its cap.

Although the accompanying drawings illustrate only a cylindrical embodiment of the container, it should be readily appreciated that the principle of the invention could be readily employed with a square, oval, rectangular or any other shape which would still permit squeezing of the cap to disengage the ramped projections. Similarly, it should be appreciated that there could be, for example in a rectangular embodiment, a number of such ramped projections along both upper and lower edges, such that squeezing the cap would disengage each of those multiple projections.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What is claimed is:

1. A point-of-sale security system for a product, said system comprising:

a container for containing said product;

a holder assembly, said holder assembly comprising a closure device for closing said container and a holder, said closure device and said container being operatively coupled together by means of cooperative members, said cooperative members being configured so that a stop member prevents their disengagement, and removal of said stop member permits their disengagement for access to the product, said stop member being integral with said holder such that removal of said holder removes said stop member and permits access to the product.

2. The point-of-sale security system as claimed in claim 1 wherein said holder is a hang tag.

3. The point-of-sale security system as claimed in claim 2, wherein said closure device comprises a cap which is integral with said hang tag.

4. The point-of-sale security system as claimed in claim 3, wherein:

said cap includes a pair of flexibly-movable parts;

said hang tag is integrally associated with said stop member; and said hang tag is configured to be severed, along with its stop member, from said cap and to be discarded, thereby disabling said stop member and permitting said cap to be decoupled from said container.

5. The point-of-sale security system as claimed in claim 4, wherein said cap includes a pair of silts to enable flexing of said two associated flexibly-movable parts of said cap, thereby to urge movement of said slits towards one another at their open ends, to enable decoupling of said cap from said container.

6. The point-of-sale security system as claimed in claim 5, wherein said cap is provided with at least two external locking ramped projections; and said container is provided with a like number of cooperating locking apertures, whereby said cap and said container may be selectively coupled and decoupled.

7. The point-of-sale security system as claimed in claim 6, wherein:

said stop member is a tongue projecting from said hang tag; and said tongue is slidably disposed within a longitudinal slot between two opposed integral, internally-oriented projections within the interior of said cap.

8. The point-of-sale security system as claimed in claim 3, wherein said cap comprises two flexibly-movable parts which are held unitary by a pair of integrally-molded straps; and said integrally-molded straps comprise said stop member;

whereby, when said straps are severed, said two parts of said cap may be urged towards one another, thereby enabling decoupling of said cap from said container.

9. The point-of-sale security system as claimed in claim 8, wherein said cap is provided with at least two external locking ramped projections; and said container is provided with a like number of cooperating locking apertures, whereby said cap and said container may be selectively coupled and decoupled.

10. The point-of-sale security system as claimed in claim 3, wherein said cap comprises two flexibly-movable parts; and said flexibly-movable parts are held together, and said cap is secured to said container, by means of a pin passing through cooperating aligned apertures in said cap and said container, said pin being secured in said apertures;

whereby, when said pin is structurally-altered to enable removable from said apertures, the two parts of said cap may be urged towards one another, thereby enabling decoupling of said cap from said container.

11. The point-of-sale security system as claimed in claim 10, wherein said two flexibly-movable parts of said cap are also held together by severable, integrally-molded straps.

12. The point-of-sale security system as claimed in claim 10, wherein:

said cap is provided with at least two external locking ramped projections; and said container is provided with a like number of cooperating locking apertures, whereby said cap and said container may be selectively coupled and decoupled.

13. The point-of-sale security system as claimed in claim 3, wherein:

said cap includes a pair of flexibly-movable parts;

said hang tag is integrally associated with said stop member; and said cap is secured to said hang tag by means of mushroom pins and cooperating apertures which are operatively associated with said hang tag and said cap;

whereby, when said mushroom pins are structurally-altered to enable removal from said apertures, the two parts of said cap may be urged towards one another to enable decoupling of said cap and said container.

14. The point-of-sale security system as claimed in claim 13, wherein:

said cap is provided with at least two external locking projections; and said container is provided with a like number of cooperating locking apertures, whereby said cap and said container may be selectively coupled and decoupled.

15. The point-of-sale security system as claimed in claim 14, wherein:

said stop member is a tongue projecting from said hang tag; and said tongue is slidably disposed within a longitudinal slot between two opposed internal, inwardly-oriented projections within the interior of said cap.

16. The point-of-sale security system as claimed in claim 3, wherein:

said cap includes an integral cap which is inset within a lower edge of said hang tag;

said hang tag is integrally associated with said stop member; and said hang tag is configured to be severed, along with its stop member, from said cap and to be discarded;

thereby disabling said stop member and permitting said cap to be decoupled from said container.

17. The point-of-sale security system as claimed in claim 16, wherein:

said cap is provided with at least two external locking ramped projections; and said container is provided with a like number of cooperating locking apertures;

whereby said cap and said container may be selectively coupled and decoupled.

18. The point-of-sale security system as claimed in claim 17, wherein:

said stop member is a tongue projecting from said hang tag; and said tongue is slidably disposed within a longitudinal slot between two opposed internal, inwardly-oriented projections within the interior of said cap.

19. The point-of-sale security system as claimed in claim 1, wherein said container is a cylindrical tube and wherein said holder assembly has at least one tab extending axially therefrom, each said tab engaging in a corresponding slot in said tube to prevent the tube from rotating about its axis while attached to said holder.

* * * * *